US007140437B2

(12) United States Patent
McMechan et al.

(10) Patent No.: US 7,140,437 B2
(45) Date of Patent: Nov. 28, 2006

(54) APPARATUS AND METHOD FOR MONITORING A TREATMENT PROCESS IN A PRODUCTION INTERVAL

(75) Inventors: David E. McMechan, Duncan, OK (US); Philip D. Nguyen, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 128 days.

(21) Appl. No.: 10/624,109

(22) Filed: Jul. 21, 2003

(65) Prior Publication Data

US 2005/0016730 A1 Jan. 27, 2005

(51) Int. Cl.
*E21B 43/04* (2006.01)

(52) U.S. Cl. ..... 166/278; 166/250.01; 166/51

(58) Field of Classification Search ..... 166/278, 166/250.01, 51, 305.1, 66
See application file for complete search history.

(56) References Cited

U.S. PATENT DOCUMENTS

| | | | |
|---|---|---|---|
| 1,975,162 | A | 10/1934 | Layne |
| 2,342,913 | A | 2/1944 | Williams et al. |
| 2,344,909 | A | 3/1944 | Williams et al. |
| 4,102,395 | A | 7/1978 | Robinson |
| 4,428,428 | A | 1/1984 | Smyrl et al. |
| 4,558,742 | A | 12/1985 | Huang et al. |
| 4,627,488 | A | 12/1986 | Szarka |
| 4,932,474 | A | 6/1990 | Schroeder, Jr. et al. |
| 4,945,991 | A | 8/1990 | Jones |
| 5,082,052 | A | 1/1992 | Jones et al. |
| 5,113,935 | A | 5/1992 | Jones et al. |
| 5,161,613 | A | 11/1992 | Jones |
| 5,161,618 | A | 11/1992 | Jones et al. |
| 5,165,476 | A | 11/1992 | Jones |
| 5,333,688 | A | 8/1994 | Jones et al. |
| 5,343,949 | A | 9/1994 | Ross et al. |
| 5,355,956 | A | 10/1994 | Restarick |
| 5,390,966 | A | 2/1995 | Cox et al. |
| 5,419,394 | A | 5/1995 | Jones |
| 5,443,117 | A | 8/1995 | Ross |
| 5,476,143 | A | 12/1995 | Sparlin et al. |

(Continued)

FOREIGN PATENT DOCUMENTS

EP 1 132 571 A1 2/2001

(Continued)

OTHER PUBLICATIONS

Restarick of Otis Engineering Copr.; "Mechanical Fluid-Loss Control Systems Used During Sand Control Operations"; 1992; pp. 21-36.

(Continued)

*Primary Examiner*—William Neuder
(74) *Attorney, Agent, or Firm*—Lawrence R. Youst

(57) ABSTRACT

An apparatus (50) for monitoring a treatment process in a treatment interval (58) includes a packer assembly (60) and a sand control screen assembly (64) connected relative to the packer assembly (60). A cross-over assembly (62) provides lateral communication paths (92, 98) downhole and uphole of the packer assembly for respectively delivering of a treatment fluid (84) and taking return fluid. A wash pipe assembly (76) is positioned in communication with the lateral communication path (98) uphole of the packer assembly (60) and extending into the interior of the sand control screen assembly (64). At least one sensor (80) is operably associated with the wash pipe assembly (76) to collect data relative to at least one property of the treatment fluid during a treatment process such that a characteristic of the treatment fluid (84) is regulatable during the treatment process based upon the data.

28 Claims, 7 Drawing Sheets

U.S. PATENT DOCUMENTS

| | | | | |
|---|---|---|---|---|
| 5,515,915 | A | 5/1996 | Jones et al. | |
| 5,588,487 | A | 12/1996 | Bryant | |
| 5,636,691 | A | 6/1997 | Hendrickson et al. | |
| 5,755,286 | A | 5/1998 | Ebinger | |
| 5,829,520 | A * | 11/1998 | Johnson | 166/250.01 |
| 5,842,516 | A | 12/1998 | Jones | |
| 5,848,645 | A | 12/1998 | Jones | |
| 5,865,251 | A | 2/1999 | Rebardi et al. | |
| 5,868,200 | A | 2/1999 | Bryant et al. | |
| 5,890,533 | A | 4/1999 | Jones | |
| 5,921,318 | A | 7/1999 | Ross | |
| 5,934,376 | A | 8/1999 | Nguyen et al. | |
| 5,988,285 | A | 11/1999 | Tucker et al. | |
| 6,003,600 | A | 12/1999 | Nguyen et al. | |
| 6,004,639 | A * | 12/1999 | Quigley et al. | 428/36.3 |
| 6,047,773 | A | 4/2000 | Zeltmann et al. | |
| 6,059,032 | A | 5/2000 | Jones | |
| 6,116,343 | A | 9/2000 | Van Petegem et al. | |
| 6,125,933 | A | 10/2000 | Ross | |
| 6,220,345 | B1 | 4/2001 | Jones et al. | |
| 6,227,303 | B1 | 5/2001 | Jones | |
| 6,230,803 | B1 | 5/2001 | Morton et al. | |
| 6,302,208 | B1 | 10/2001 | Walker et al. | |
| 6,343,651 | B1 * | 2/2002 | Bixenman | 166/278 |
| 6,450,263 | B1 | 9/2002 | Schwendemann | |
| 6,464,007 | B1 | 10/2002 | Jones | |
| 6,516,881 | B1 | 2/2003 | Hailey, Jr. | |
| 6,516,882 | B1 | 2/2003 | McGregor et al. | |
| 6,554,064 | B1 | 4/2003 | Restarick et al. | |
| 6,554,065 | B1 * | 4/2003 | Fisher et al. | 166/253.1 |
| 6,557,634 | B1 | 5/2003 | Hailey, Jr. et al. | |
| 6,581,689 | B1 | 6/2003 | Hailey, Jr. | |
| 6,588,507 | B1 | 7/2003 | Dusterhoft et al. | |
| 6,684,951 | B1 * | 2/2004 | Restarick et al. | 166/250.01 |
| 6,729,398 | B1 * | 5/2004 | Ringgenberg et al. | 166/250.01 |
| 6,805,202 | B1 | 10/2004 | Gillespie et al. | |
| 6,817,410 | B1 * | 11/2004 | Wetzel et al. | 166/233 |
| 2003/0056948 | A1 | 3/2003 | Cameron | |
| 2003/0111224 | A1 | 6/2003 | Halley, Jr. et al. | |

FOREIGN PATENT DOCUMENTS

| | | | |
|---|---|---|---|
| WO | WO 99/12630 | | 3/1999 |
| WO | WO 00/61913 | | 10/2000 |
| WO | WO 01/14691 | A1 | 3/2001 |
| WO | WO 01/42620 | A1 | 6/2001 |
| WO | WO 01/44619 | A1 | 6/2001 |
| WO | WO 01/49970 | A1 | 7/2001 |
| WO | WO 02/10554 | A1 | 2/2002 |

OTHER PUBLICATIONS

Halliburton Energy Services, Inc.; "Sand Control Screens"; 1994; 4 pages.

Ebinger of Ely & Associates Inc.; "Frac Pack Technology Still Evolving"; 1995; pp. 60-70; Oil & Gas Journal.

Hailey and Cox of Haliburton Energy Services, Inc. and Johnson of BP Exploration (Alaska); "Screenless Single Trip Multizone Sand Control Tool System Saves Rig Time"; Feb. 2000; pp. 1-11; Society of Petroleum Engineers Inc.

Halliburton Energy Services, Inc.; "Caps Sand Control Service for Horizontal Completions Improves Gravel Pack Reliability and Increases Production Potential from Horizontal Completions"; Aug. 2000; 2 pages.

Halliburton Energy Services, Inc.; "CAPS Concertric Annular Packing Service for Sand Control"; Aug. 2000; 4 pages.

Saldungaray of Schlumberger, Troncoso and Santoso of Repsol-YPF; "Simultaneous Gravel Packing and Filter Cake Removal in Horizontal Wells Applying Shunt Tubes and Novel Carrier and Breaker Fluid": Mar. 2001: pp. 1-6: Society of Petroleum Engineers, Inc.

Schlumberger; "QUANTUM Zonal Isolation Tool"; pp. 12-13; Sand Face Completions Catalog.

Halliburton Energy Services, Inc.; "Absolute Isolation System (AIS) Components"; 1 page.

OSCA Corporate Headquarters; "HPR-ISO System"; 2000; 1 page; Technical Bulletin.

OSCA Corporate Headquarters; "The ISO System"; 2000; 1 page; Technical Bulletin.

International Search Report; Sep. 13, 2004; 3 pages.

* cited by examiner

APPARATUS AND METHOD FOR MONITORING A TREATMENT PROCESS IN A PRODUCTION INTERVAL

TECHNICAL FIELD OF THE INVENTION

This invention relates in general to preventing the production of particulate materials through a wellbore traversing an unconsolidated or loosely consolidated subterranean formation and in particular to an apparatus and method for monitoring gravel placement throughout the entire length of a production interval.

BACKGROUND OF THE INVENTION

Without limiting the scope of the present invention, its background is described with reference to the production of hydrocarbons through a wellbore traversing an unconsolidated or loosely consolidated formation, as an example.

It is well known in the subterranean well drilling and completion arts that particulate materials such as sand may be produced during the production of hydrocarbons from a well traversing an unconsolidated or loosely consolidated subterranean formation. Numerous problems may occur as a result of the production of such particulate. For example, the particulate causes abrasive wear to components within the well, such as tubing, pumps and valves. In addition, the particulate may partially or fully clog the well creating the need for an expensive workover. Also, if the particulate matter is produced to the surface, it must be removed from the hydrocarbon fluids by processing equipment at the surface.

One method for preventing the production of such particulate material to the surface is gravel packing the well adjacent the unconsolidated or loosely consolidated production interval. In a typical gravel pack completion, a sand control screen is lowered into the wellbore on a work string to a position proximate the desired production interval. A fluid slurry including a liquid carrier and a particulate material known as gravel is then pumped down the work string and into the well annulus formed between the sand control screen and the perforated well casing or open hole production zone.

Typically, the liquid carrier is returned to the surface by flowing through the sand control screen and up a wash pipe. The gravel is deposited around the sand control screen to form a gravel pack, which is highly permeable to the flow of hydrocarbon fluids but blocks the flow of the particulate carried in the hydrocarbon fluids. As such, gravel packs can successfully prevent the problems associated with the production of particulate materials from the formation.

It has been found, however, that a complete gravel pack of the desired production interval is difficult to achieve particularly in long production intervals that are inclined, deviated or horizontal. One technique used to pack a long production interval that is inclined, deviated or horizontal is the alpha-beta gravel packing method. In this method, the gravel packing operation starts with the alpha wave depositing gravel on the low side of the wellbore progressing from the near end to the far end of the production interval. Once the alpha wave has reached the far end, the beta wave phase begins wherein gravel is deposited in the high side of the wellbore, on top of the alpha wave deposition, progressing from the far end to the near end of the production interval.

It has been found, however, that as the desired length of horizontal formations increases, it becomes more difficult to achieve a complete gravel pack even using the alpha-beta technique. Therefore, a need has arisen for an improved apparatus and method for gravel packing a long production interval that is inclined, deviated or horizontal. A need has also arisen for such an improved apparatus and method that achieve a complete gravel pack of such production intervals. Further, a need has arisen for such an improved apparatus and method that provide for enhanced control over the gravel placement process in substantially real time.

SUMMARY OF THE INVENTION

Accordingly, the present invention provides an apparatus and method for gravel packing long production intervals that are inclined, deviated or horizontal. The present invention overcomes the limitations of the existing methodologies by providing for enhanced control over the gravel placement process. In particular, the apparatus and method of the present invention enable fluid properties within a production interval of a wellbore to be monitored in substantially real time, thereby allowing substantially real time adjustments to be made during a gravel packing operation.

In one aspect, the present invention is directed to an apparatus for treating a production interval of a wellbore. The apparatus includes a packer assembly and a sand control screen assembly connected relative to the packer assembly. A cross-over assembly provides a lateral communication path downhole of the packer assembly for delivery of a treatment fluid and a lateral communication path uphole of the packer assembly for a return fluid. A wash pipe assembly is positioned in communication with the lateral communication path uphole of the packer assembly and extends into the interior of the sand control screen. At least one sensor is operably associated with the wash pipe assembly in order to collect data relative to at least one property of the treatment fluid during a treatment process such that a characteristic of the treatment fluid is regulatable during the treatment process based upon the data.

In one embodiment, the wash pipe comprises a body that includes a plurality of composite layers and a substantially impermeable layer lining an inner surface of the innermost composite layer forming a pressure chamber. In this embodiment, an energy conductor is integrally positioned within the body. The sensor may be directly or inductively coupled to the energy conductor which may take the form of an optical fiber that provides for communication between the sensor and other downhole devices such as a downhole processor or the surface. The sensor may measure properties of the treatment fluid such as viscosity, temperature, pressure, velocity, specific gravity, conductivity, fluid composition and the like. In one embodiment, a series of sensors may be embedded within the body of the wash pipe at predetermined intervals such that the treatment fluid properties may be monitored as a function of position along the length of the interval. Based upon the data collected by the sensors, various characteristics of the treatment fluid may be regulated such as fluid viscosity, proppant concentration, flow rate and the like. In one embodiment, the apparatus may further comprise a downhole mixer which provides a mixing area wherein constituent parts of the treatment fluid such as the carrier fluid and the solids are combined to form the fluid slurry downhole which reduces the delay in the downhole effect of the real time regulation of treatment fluid characteristics.

In another aspect, the present invention is directed to an apparatus for monitoring treatment fluid in a production interval of a wellbore during a treatment process. The apparatus comprising at least one sensor operably positioned within the production interval of the wellbore, wherein the sensor is operable to collect data relative to at least one property of the treatment fluid during the treatment process such that at least one characteristic of the treatment fluid is regulatable during the treatment process based upon the data.

In one embodiment, the sensor is operably associated with a tubular that may comprise a substantially impermeable layer lining an inner surface of a composite structure forming a pressure chamber therein. The tubular may form a portion of a washpipe, a base pipe, a production tubing or the like. The sensor may be attached or embedded within the inner surface of the composite structure or may be attached or embedded on the exterior of the body of the composite structure.

In a further aspect, the present invention is directed to a method for treating a production interval of a wellbore. The method includes positioning a sand control screen assembly within the production interval, disposing a wash pipe assembly interiorly of the sand control screen assembly, injecting a treatment fluid into the production interval exteriorly of the sand control screen assembly, sensing data relative to a property of the treatment fluid during the injecting with a sensor operably associated with the wash pipe and regulating a characteristic of the treatment fluid during the injecting based upon the data.

In one embodiment, the sensor is directly or inductively coupled to an energy conductor that is operably associated with the wash pipe such as an optical fiber integrally associated with the wash pipe. The data may include information relative to fluid viscosity, temperature, pressure, velocity, specific gravity, conductivity, fluid composition or the like. Once the data is processed either at the surface or by a downhole processor, real time alterations to the treatment may be performed such as regulating the fluid viscosity of the treatment fluid, regulating the proppant concentration of the treatment fluid, regulating the flow rate of the treatment fluid or the like.

In another aspect, the present invention is directed to a method for monitoring treatment fluid in a production interval of a wellbore during a treatment process. The method includes positioning at least one sensor within the production interval of the wellbore, sensing data relative to a property of the treatment fluid during the treatment process and regulating a characteristic of the treatment fluid during the treatment process based upon the data.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
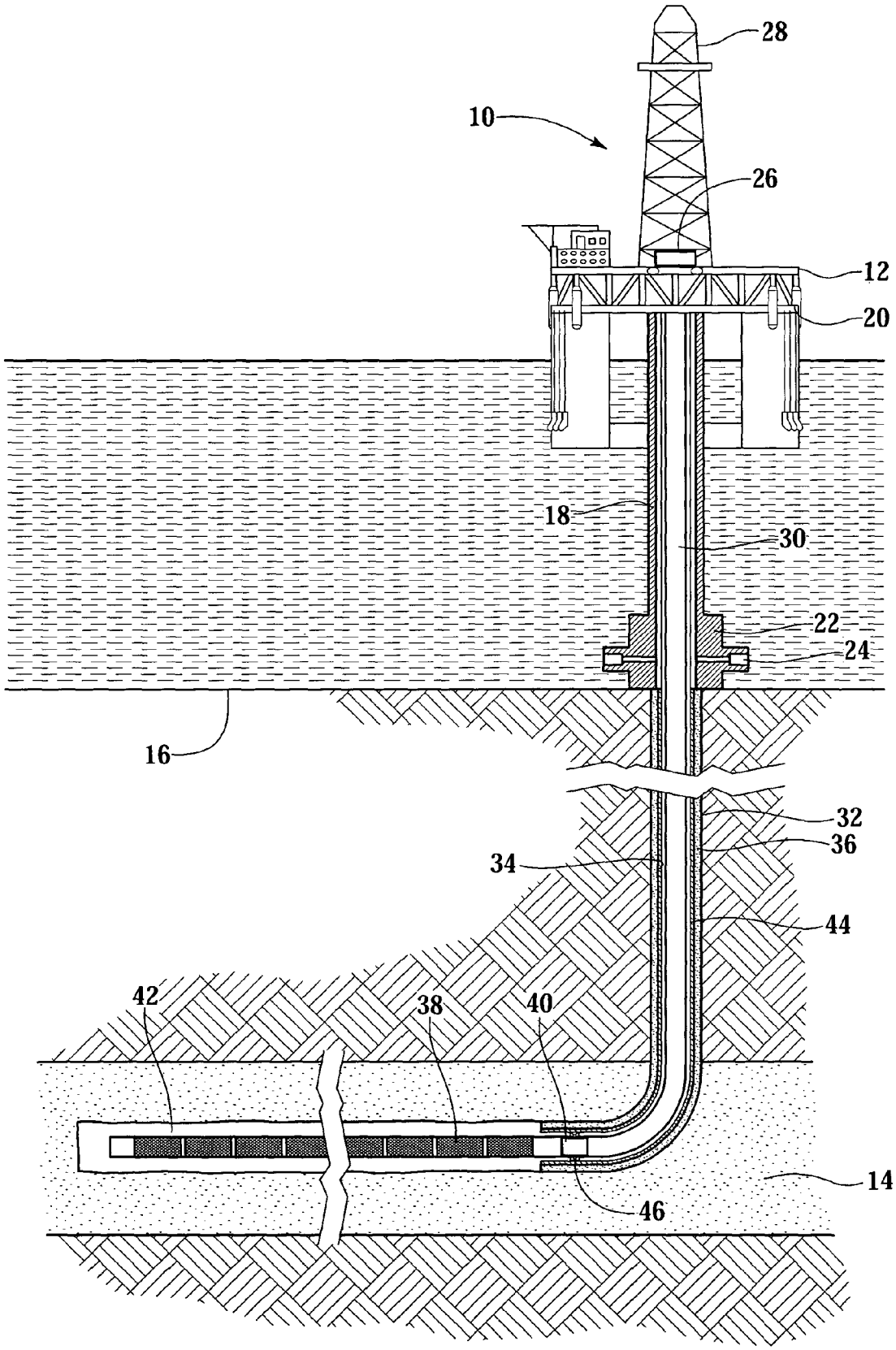
FIG. 1 is a schematic illustration of an offshore oil and gas platform operating an apparatus for gravel packing a production interval of a wellbore in accordance with the teachings of the present invention.

Referring initially to FIG. 1, an apparatus for gravel packing a horizontal open hole production interval of a wellbore operating from an offshore oil and gas platform is schematically illustrated and generally designated 10. A semi-submersible platform 12 is centered over a submerged oil and gas formation 14 located below sea floor 16. A subsea conduit 18 extends from deck 20 of platform 12 to wellhead installation 22 including blowout preventers 24. Platform 12 has a hoisting apparatus 26 and a derrick 28 for raising and lowering pipe strings such as work string 30.

A wellbore 32 extends through the various earth strata including formation 14. A casing 34 is cemented within a portion of wellbore 32 by cement 36. Work string 30 extends beyond the end of casing 34 and includes a series of sand control screen assemblies 38 and a cross-over assembly 40 for gravel packing the horizontal open hole production interval 42 of wellbore 32. When it is desired to gravel pack production interval 42, work string 30 is lowered through casing 34 such that sand control screen assemblies 38 are suitably positioned within production interval 42. Thereafter, a fluid slurry including a liquid carrier and a particulate material such as sand, gravel or proppants is pumped down work string 30.

As explained in more detail below, the fluid slurry is injected into production interval 42 through cross-over assembly 40. Once in production interval 42, the gravel in the fluid slurry is deposited therein using the alpha-beta method wherein gravel is deposited on the low side of production interval 42 from the near end to the far end of production interval 42 then in the high side of production interval 42, on top of the alpha wave deposition, from the far end to the near end of production interval 42. While some of the liquid carrier may enter formation 14, the remainder of the liquid carrier travels through sand control screen assemblies 38, into a wash pipe (not pictured) and up to the surface via annulus 44 above packer 46. Sensors distributed along the length of production interval 42 monitor the fluid slurry at various locations and relay data relative to the fluid slurry to a downhole processor or to the surface. Various characteristics of the fluid slurry such as proppant concentration, fluid viscosity, fluid flow rate and the like may be regulated based on the relayed data to avoid, for example, sand bridges and to insure a complete gravel pack within production interval 42.

Even though FIG. 1 and the following figures depict a horizontal wellbore and even through the term horizontal is being used to describe the orientation of the depicted wellbore, it should be understood by those skilled in the art that the present invention is equally well suited for use in wellbores having other orientations including inclined or deviated wellbores. Accordingly, the use of the term horizontal herein is intended to include such inclined and deviated wellbores and is intended to specifically include any wellbore wherein it is desirable to use the alpha-beta gravel packing method. Additionally, it will be appreciated that the present invention is not limited to open hole production intervals. Moreover, it should be appreciated that the present invention is not limited to alpha-beta gravel packing treatments. As should be understood by those skilled in the art, the teachings of the present invention are also applicable to other treatment processes such as fracturing, frac packing, acid or other chemical treatments, resin consolidations, conformance treatments or any other treatment processes involving the pumping of a fluid into a downhole environment wherein it is beneficial to monitor various fluid properties as a function of position and use this data to regulate various treatment fluid characteristics during the treatment process.

Figure 2:
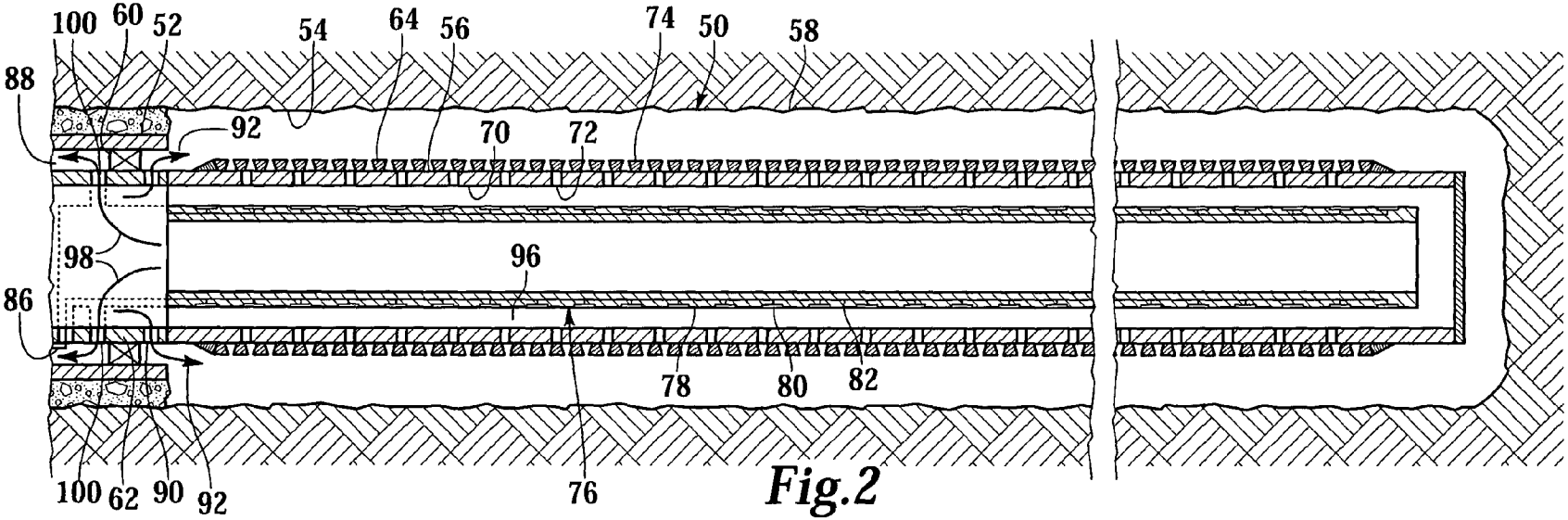
FIG. 2 is a half sectional view depicting the operation of an apparatus for gravel packing a horizontal open hole production interval of a wellbore of the present invention.

Referring now to FIG. 2, therein is depicted a horizontal open hole production interval of a wellbore that is generally designated 50. Casing 52 is cemented within a portion of a wellbore 54 proximate the heel or near end of the horizontal portion of wellbore 54. A work string 56 extends through casing 52 and into the open hole production interval 58 of wellbore 54. A packer assembly 60 is positioned between work string 56 and casing 52 at a cross-over assembly 62. Work string 56 includes a sand control screen assembly 64. Sand control screen assembly 64 includes a base pipe 70 that has a plurality of openings 72 which allow the flow of production fluids into the production tubing. The exact number, size and shape of openings 72 are not critical to the present invention, so long as sufficient area is provided for fluid production and the integrity of base pipe 70 is maintained.

Wrapped around base pipe 70 is a screen wire 74. Screen wire 74 forms a plurality of turns with gaps therebetween through which formation fluids flow. The number of turns and the gap between the turns are determined based upon the characteristics of the formation from which fluid is being produced and the size of the gravel to be used during the gravel packing operation. Screen wire 74 may be wrapped directly on base pipe 70 or may be wrapped around a plurality of ribs (not pictured) that are generally symmetrically distributed about the axis of base pipe 70. The ribs may have any suitable cross sectional geometry including a cylindrical cross section, a rectangular cross section, a triangular cross section or the like. In addition, the exact number of ribs will be dependant upon the diameter of base pipe 70 as well as other design characteristics that are well known in the art.

It should be understood by those skilled in the art that while FIG. 2 has depicted a wire wrapped sand control screen, other types of filter media could alternatively be used in conjunction with the apparatus of the present invention, including, but not limited to, a fluid-porous, particulate restricting, diffusion bonded or sintered metal material such as a plurality of layers of a wire mesh that form a porous wire mesh screen designed to allow fluid flow therethrough but prevent the flow of particulate materials of a predetermined size from passing therethrough.

Disposed within work string 56 and extending from cross-over assembly 62 is a wash pipe assembly 76. Wash pipe assembly 76 extends substantially to the far end of work string 56 near the toe or far end of production interval 58. In the illustrated embodiment, wash pipe assembly 76 is a composite coiled tubing 78 that includes a series of sensors 80 embedded at predetermined intervals along wash pipe assembly 76 each of which is connected to one of a plurality of energy conductors 82 integrally positioned within composite coiled tubing 78. As illustrated, sensors 80 include optical pressure sensors. It should be appreciated, however, that other types of pressure sensors may be used, including, but not limited to, electronic pressure sensors and the like. Moreover, as will be explained in further detail hereinbelow, the sensors may include viscosity sensors, temperature sensors, velocity sensors, specific gravity sensors, conductivity sensors, fluid composition sensors and the like. Additionally, it should be appreciated that multiple types of sensors may be employed together to collect data. For example, temperature sensors, pressure sensors and conductivity sensors may be employed together to achieve a better understanding of downhole conditions. Also, even though sensors 80 are depicted as being directly coupled to energy conductors 82, it should be understood by those skilled in the art that sensors 80 could alternatively communicate with energy conductor 82 by other means including, but not limited to, by inductive coupling.

Figure 3:
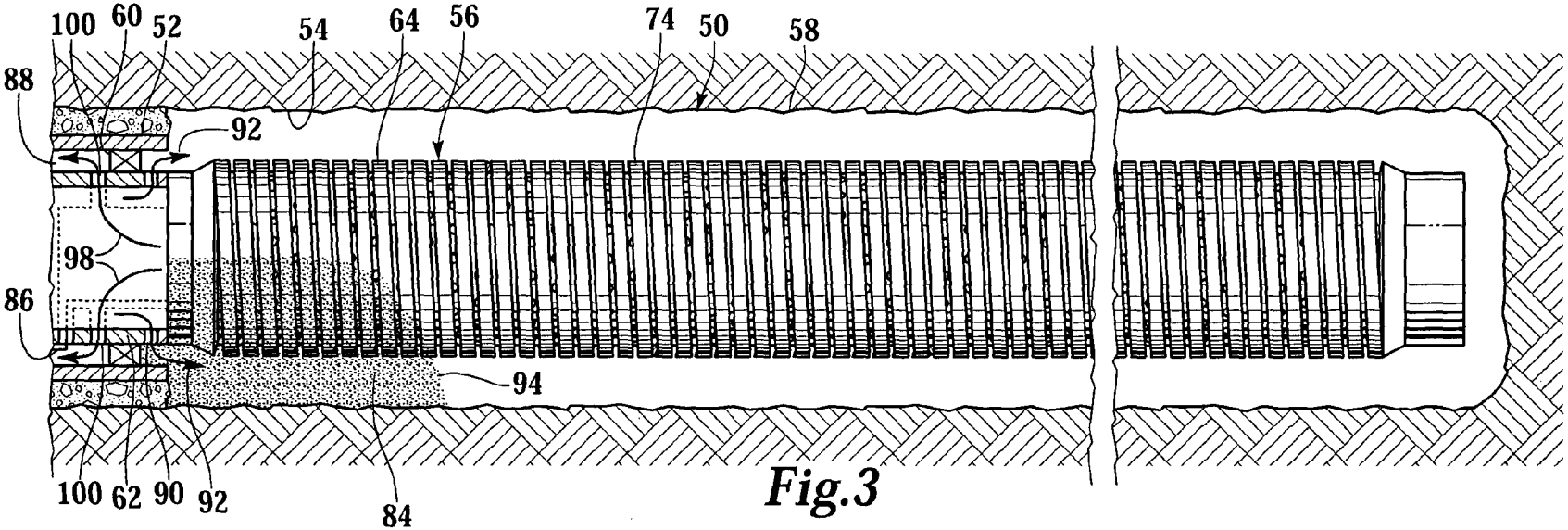
FIG. 3 is a partial half sectional view depicting the operation of an apparatus for gravel packing a horizontal open hole production interval of a wellbore of the present invention during the propagation of an alpha wave.

Referring now to FIG. 2 and FIG. 3 in which the operation of the apparatus for gravel packing the horizontal open hole production interval of the wellbore during the propagation of an alpha wave is depicted. Sensors 80 monitor data relative to the various properties of fluid slurry 84 and the downhole environment in production interval 58 and relay this data to a downhole processor or to the surface so that the composition of fluid slurry 84 may be regulated by regulating various fluid characteristics such as fluid viscosity, proppant concentration and flow rate of fluid slurry 84. Energy conductors 82 are preferably fiber optic strands that carry optical information. The fiber optic strands may form a bundle 86 at the top of wash pipe assembly 76 which extends to the surface in annulus 88. Alternatively, energy conductor 82 may be electrical wires. Communication may alternatively be achieved using a downhole telemetry system such as an electromagnetic telemetry system, an acoustic telemetry system or other wireless telemetry system that is known or subsequently discovered in the art for communications with the surface or a downhole processor.

During a gravel packing operation, the objective is to uniformly and completely fill horizontal production interval 58 with gravel. This is achieved by delivering a fluid and gravel slurry 84 down work string 56 into cross-over assembly 62. Fluid slurry 84 containing gravel exits cross-over assembly 62 through cross-over ports 90 and is discharged into horizontal production interval 58 as indicated by arrows 92. In the illustrated embodiment, fluid slurry 84 containing gravel then travels within production interval 58 with portions of the gravel dropping out of the slurry and building up on the low side of wellbore 54 from the heel to the toe of wellbore 54 as indicated by alpha wave front 94 of the alpha wave portion of the gravel pack. At the same time, portions of the carrier fluid of the fluid slurry pass through sand control screen assembly 64 and travel through annulus 96 between wash pipe assembly 76 and the interior of sand control screen assembly 64. These return fluids enter the far end of wash pipe assembly 76, flow back through wash pipe assembly 76 to cross-over assembly 62, as indicated by arrows 98, and flow into annulus 88 through cross-over ports 100 for return to the surface.

As the propagation of alpha wave front 94 continues from the heel to the toe of horizontal production interval 58, sensors 80 monitor data relative to fluid slurry 84 and the downhole environment such as viscosity, temperature, pressure, velocity, fluid composition and the like, to ensure proper placement of the gravel and to avoid, for example, sand bridge formation with wellbore 54.

Figure 4:
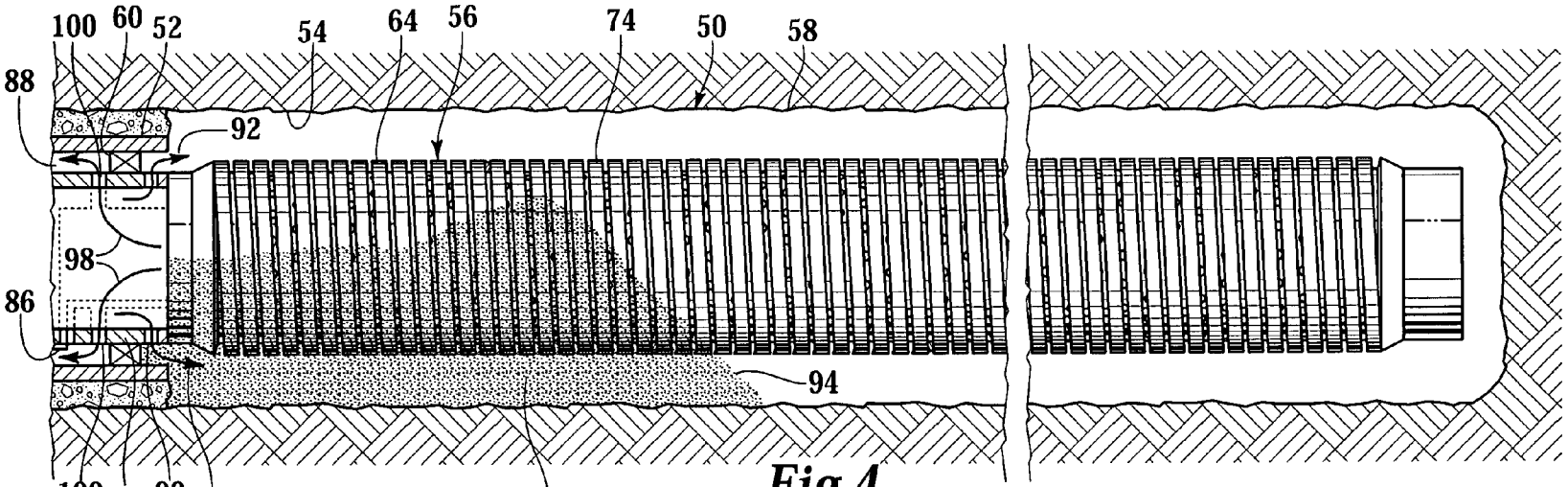
FIG. 4 is a partial half sectional view depicting the operation of the apparatus for gravel packing the horizontal open hole production interval of the wellbore of the present invention during the propagation of the alpha wave.

Using sensors 80 of the present invention, the height of alpha deposition within production interval 58 may be regulated. Specifically, as best seen in FIG. 4, during the alpha wave portion of the gravel placement, portions of the alpha deposition are building up toward the high side of wellbore 54. The changes in pressure caused by the build up of the alpha deposition are monitored by sensors 80 such that data may be sent to the surface or to a downhole processor in substantially real time, such that fluid slurry characteristics such as fluid viscosity, proppant concentration and flow rate of fluid slurry may be adjusted.

Figure 5:
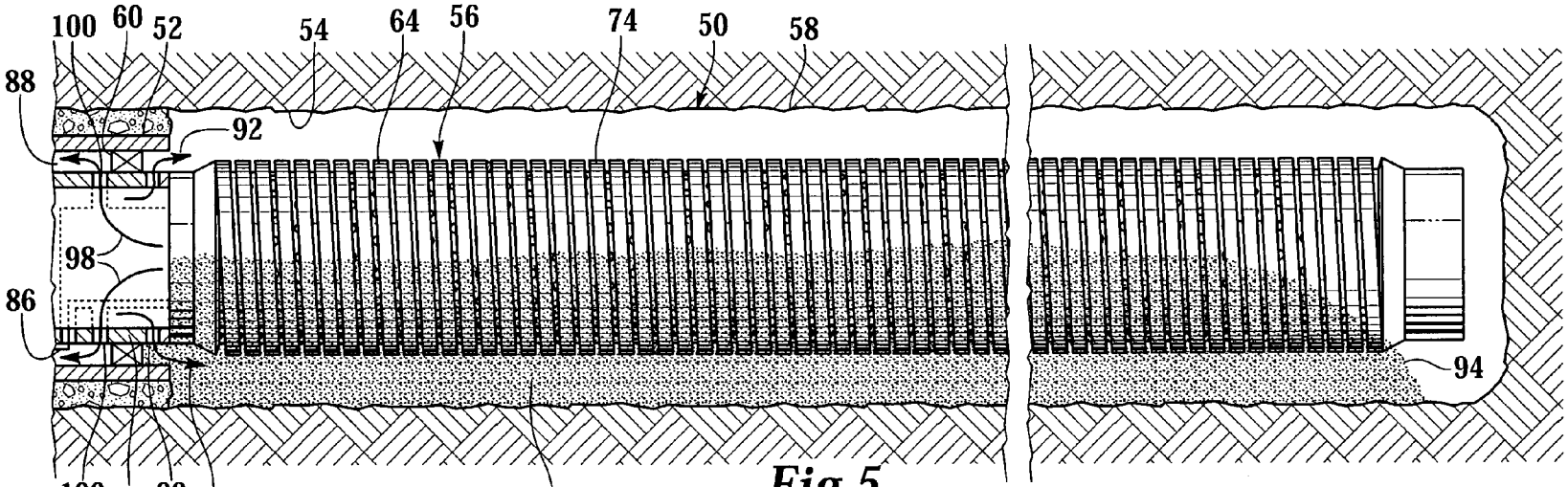
FIG. 5 is a partial half sectional view depicting the operation of the apparatus for gravel packing the horizontal open hole production interval of the wellbore of the present invention after a real time adjustment in the gravel packing slurry during the propagation of the alpha wave.

Referring now to FIG. 5, responsive to the real time indications that the alpha deposition is too high, the composition, flow rate or other characteristic of fluid slurry 84 is adjusted so that the height of the alpha deposition can be returned to a desirable level in substantially real time, as illustrated. Accordingly, by positioning sensors 80 at predetermined intervals, the present invention provides for the collection, recording and analysis of substantially real time data as a function of position relative to physical qualities within the wellbore. In this regard, the exact number of sensors and spacing of the sensors will be dependent on the specific type of treatment process being performed. It should be appreciated that a variety of sensors may be used to measure a variety of qualities to regulate the completion process. For example, properly positioned sensors could measure the change in the density of fluid slurry 84 within production interval 58. Specifically, as the composition of constituent matter in production interval 58 at a particular sensor changes from a fluid slurry to a gravel pack as alpha wave front 94 passes a location, the density at this location significantly increases. Accordingly, by sensing the density at this location, the progress of alpha wave front 94 may be monitored and regulated. Other properties such as absolute pressure, absolute temperature, upstream-downstream differential temperature, flow velocity in production interval 58 and the like could also be measured by sensors 80 to regulate the alpha deposition. Hence, by improving the control over gravel placement the present invention insures a more complete gravel pack along the entire length of the production interval. In particular, the present invention ensures complete gravel packs of long, horizontal wellbores by providing substantially real time data relative to a plurality of locations along the completion interval.

Figure 6:
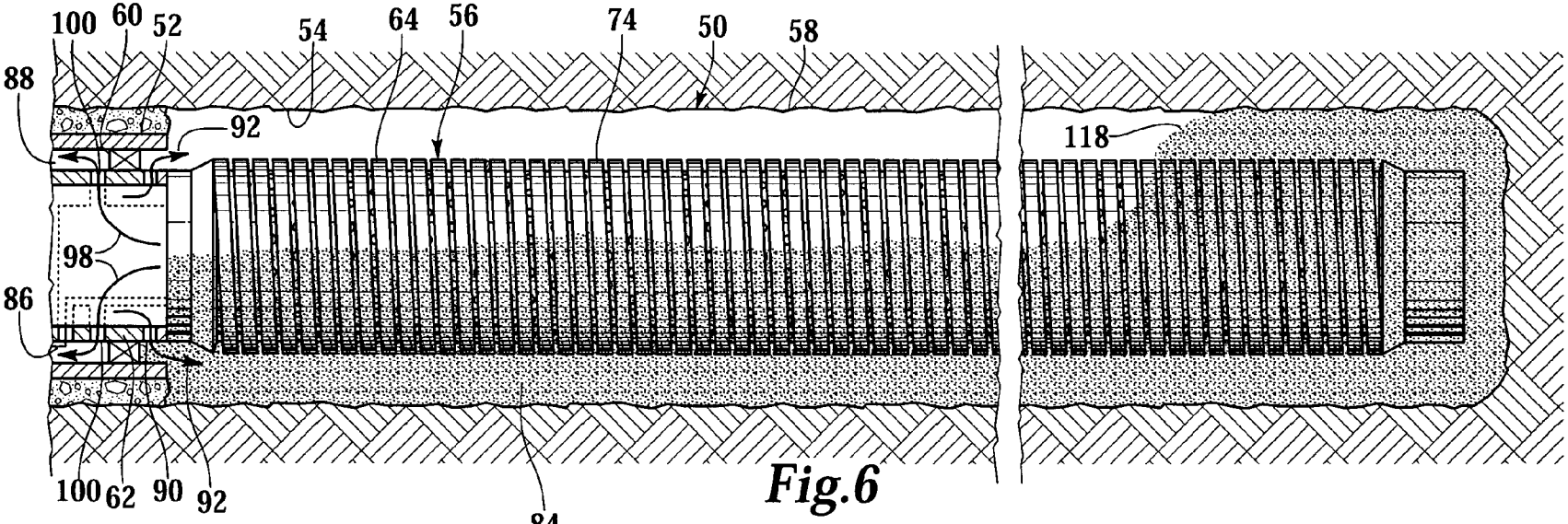
FIG. 6 is a partial half sectional view depicting the operation of the apparatus for gravel packing the horizontal open hole production interval of the wellbore of the present invention during the propagation of a beta wave.
Figure 7:
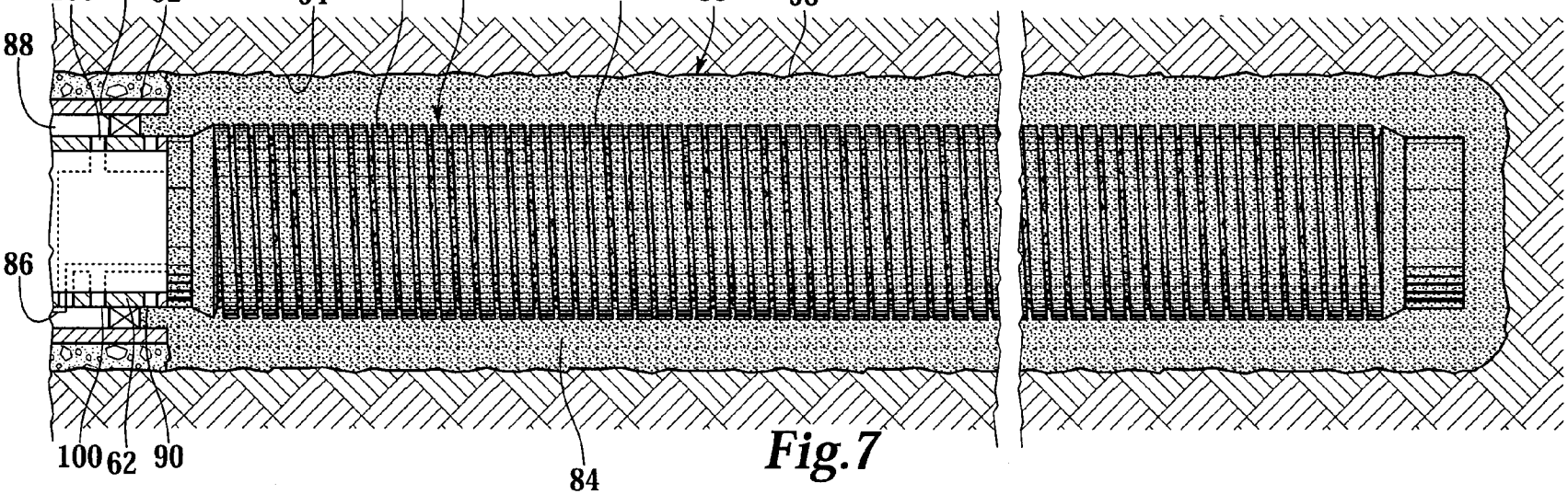
FIG. 7 is a partial half sectional view depicting the operation of the apparatus for gravel packing the horizontal open hole production interval of the wellbore of the present invention at the completion stage of the treatment process.

Referring now to FIG. 6, as the beta wave portion of the treatment process progresses, sensors 80 monitor the progress of beta wave front 118, fluid slurry 84 and the wellbore environment and relay the monitored data to a downhole processor or to the surface so that various parameters of the gravel slurry may be regulated in substantially real time to ensure a complete gravel pack. FIG. 7 depicts wellbore 54 after the beta wave gravel placement step and the treatment process of production interval 58 is complete. It should be appreciated that the present invention is applicable not only to gravel placement processes, but also to other fluid treatments such as stimulations, fractures, acid treatments and the like. Following the completion process, sensors 80 of the present invention may continue to be employed to provide the downhole hardware necessary to monitor one or more physical qualities of the wellbore including production fluid properties. In this respect, the teachings presented herein are not limited to the completion phases of a wellbore, but are also applicable to other phases of a wellbore including production. For example, after the completion of wellbore, the sensors of the present invention provide real time measurements at a series of points along the production interval that allow information to be obtained as a function of position relative to the location or locations of hydrocarbon production, water encroachment, gas breakthrough and the like.

Figure 8:
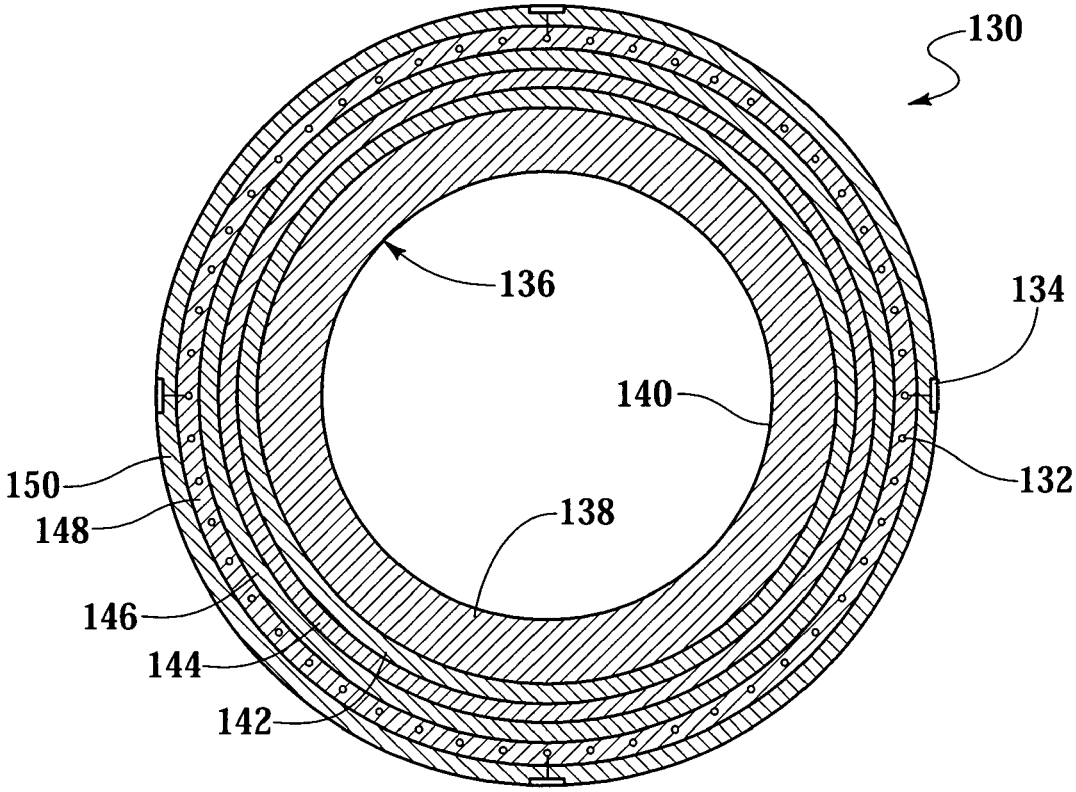
FIG. 8 is a cross sectional view depicting a composite coiled tubing having energy conductors and sensors embedded therein in accordance with the teachings of the present invention.

Referring now to FIG. 8, a composite coiled tubing 130 having energy conductors 132 and sensors 134 embedded therein is depicted. Composite coiled tubing 130 includes an inner fluid passageway 136 defined by an inner thermoplastic liner 138 that provides a body upon which to construct the composite coiled tubing 130 and that provides a relative smooth interior bore 140. Fluid passageway 136 provides a conduit for transporting fluids such as the completion and production fluids discussed hereinabove. Layers of braided or filament wound material such as Kevlar or carbon encapsulated in a matrix material such as epoxy surround liner 138 forming a plurality of generally cylindrical layers, i.e., a composite structure, such as layers 142, 144, 146, 148, 150 of composite coiled tubing 130.

The materials of composite coiled tubing 130 provide for high axial strength and stiffness while also exhibiting high pressure carrying capability and low bending stiffness. For spooling purposes, composite coiled tubing 130 is designed to bend about the axis of the minimum moment of inertia without exceeding the low strain allowable characteristic of uniaxial material, yet be sufficiently flexible to allow the assembly to be bent onto the spool.

Layer 148 has energy conductors 132 that may be employed for a variety of purposes. For example, energy conductors 132 may be power lines, control lines, communication lines or the like. Preferably, energy conductors 132 may be optical fiber strands wound within layer 148. Sensors 134 are embedded within outer layer 150 and are coupled to one of the energy conductors 132. Sensors 134 may provide data relative to viscosity, temperature, pressure, velocity, specific gravity, conductivity, fluid composition, or the like. For example, sensors 134 may be fiber optic pressure sensor that measure the pressure in the region surrounding composite coiled tubing 130. Alternatively, sensors 134 may be strain gage pressure sensors, or micro sensors such as a micro electrical sensors. As another example, sensors 134 may be electrodes operable to detect the presence of non-conducting oil or conducting water. Additionally, it should be appreciated that a variety of types of sensors may be employed to collect data about a fluid surrounding composite coiled tubing 130. Moreover, it will be appreciated that the selection of sensors will be dependant upon the desired attributes to be monitored within the well.

Although a specific number of energy conductors 132 and sensors 134 are illustrated, it should be understood by one skilled in the art that more or less energy conductors 132 or sensors 134 than illustrated are in accordance with the teachings of the present invention. Moreover, it should be appreciated that sensors 134 may alternatively be embedded within interior bore 140 or within both interior bore 140 and outer layer 150.

The design of composite coiled tubing 130 provides for fluid to be conveyed in fluid passageway 136 and energy conductors 132 and sensors 134 to be positioned in the matrix about fluid passageway 136. It should be understood by those skilled in the art that while a specific composite coiled tubing is illustrated and described herein, other composite coiled tubings having a fluid passageway and one or more energy conductors could alternatively be used and are considered within the scope of the present intention.

Figure 9:
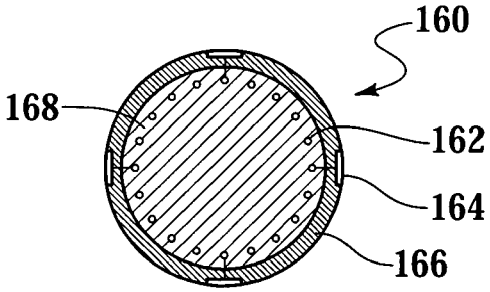
FIG. 9 is a cross sectional view depicting an alternate embodiment of a composite coiled tubing having energy conductors and sensors embedded therein in accordance with the teachings of the present invention.

For example, with reference to FIG. 9, an alternate embodiment of a composite coiled tubing 160 having energy conductors 162 and sensors 164 embedded therein in accordance with the teachings of the present invention is illustrated. Layers 166, 168 of braided or filament wound material encapsulated in a matrix material form a composite structure. Contrary to composite coiled tubing 130 of FIG. 7, composite coiled tubing 160 does not include a conduit for transporting fluids. Similar to composite coiled tubing 130 of FIG. 7, a plurality of energy conductors 162, which may take the form of optical fibers, are embedded in the matrix to relay data between sensors 164 and the surface. It should be appreciated that the composite coil tubing presented in FIGS. 7 and 8 are not limited to tubular goods or tubings having circular cross-sections. The teachings of the present invention are applicable to composite coiled tubings having non-circular cross-sections such as rectangular or irregular cross-sections.

Figure 10:
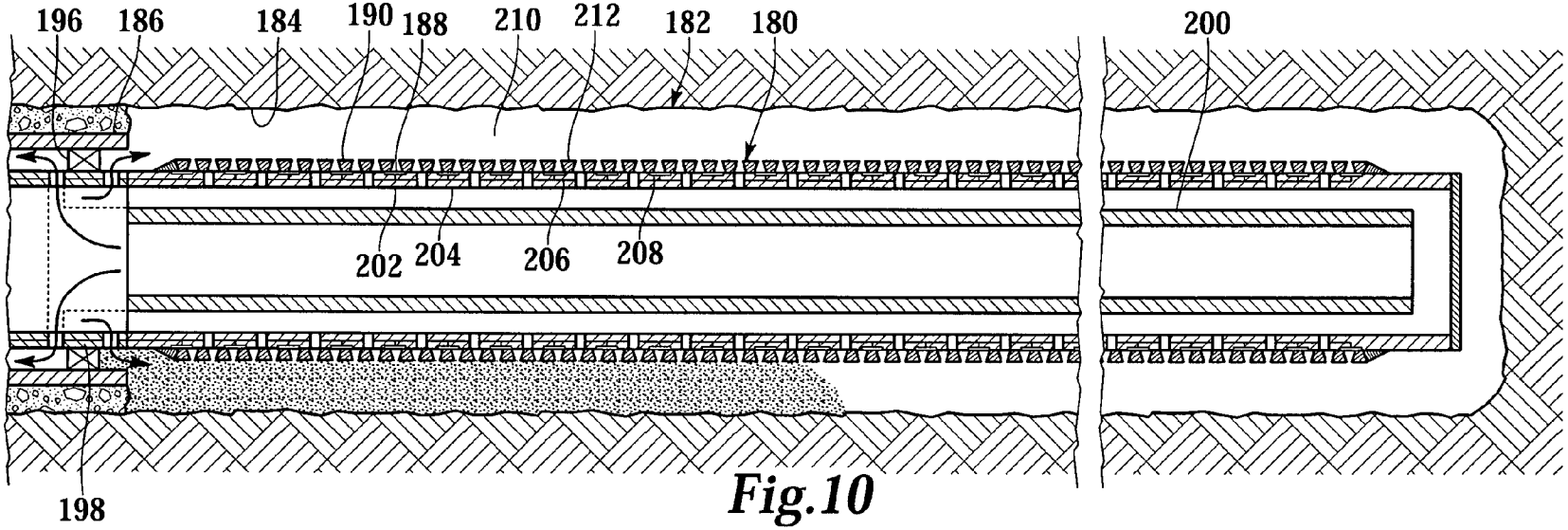
FIG. 10 is a half sectional view depicting the operation of an alternate embodiment of an apparatus for gravel packing a horizontal open hole production interval of a wellbore of the present invention.

FIG. 10 is a half sectional view depicting the operation of an alternate embodiment of an apparatus 180 for gravel packing a horizontal open hole production interval 182 of a wellbore 184 of the present invention during a treatment operation. Casing 186 is cemented within a portion of wellbore 184. Work string 188 includes a sand control screen assembly 190 that extends into open hole production interval 182 of wellbore 184. Packer assembly 196 is positioned between work string 188 and casing 186 at a cross-over assembly 198. Disposed within work string 188 and extending from cross-over assembly 198 is a wash pipe assembly 200.

Sand control screen assembly 190 includes base pipe 202 which comprises composite coiled tubing 204 that includes energy conductors 206 integrally positioned therein. A series of sensors 208 embedded on the outer surface of base pipe 202 are coupled to energy conductors 206 to monitor fluid properties within an annulus 210 formed between base pipe 202 and wellbore 184. Preferably, sensors 208 are embedded on base pipe 202 inside of screen wire 212. As illustrated, during an alpha-beta gravel packing operation, sensors 208 positioned on the exterior of base pipe 202 monitor fluid properties and the wellbore environment within annulus 210 to determine any number of a variety of wellbore properties including fluid viscosity, temperature, pressure, fluid velocity, fluid specific gravity, fluid conductivity and fluid composition. The measured data is relayed to a downhole processor or to the surface in substantially real time via energy conductors 206. Energy conductors 206 may extend to the surface embedded within work string 188 which may be formed entirely as a composite coiled tubing. Alternatively, energy conductors 206 may form a bundle that extends to the surface within the annulus between work string 188 and casing 186.

Figure 11:
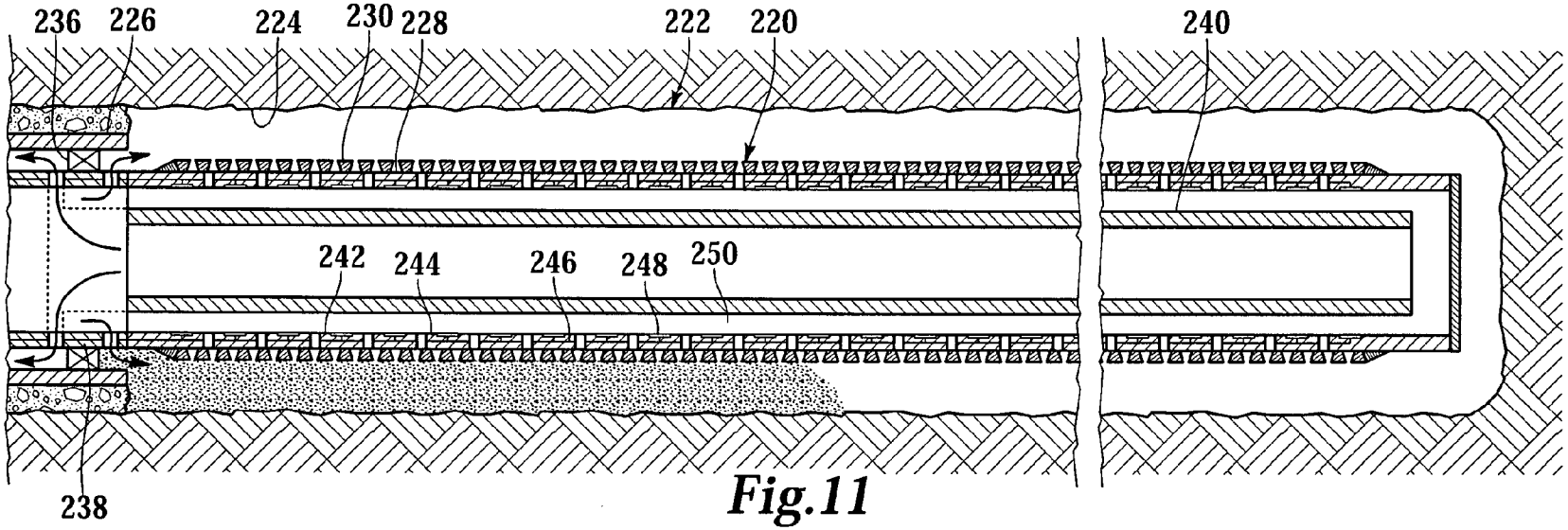
FIG. 11 is a half sectional view depicting the operation of a further embodiment of an apparatus for gravel packing a horizontal open hole production interval of a wellbore of the present invention.

FIG. 11 is another embodiment of an apparatus 220 for gravel packing a horizontal open hole production interval 222 of a wellbore 224 of the present invention during a treatment operation. Similar to FIG. 10, the production interval of FIG. 11 includes a casing 226, a work string 228, sand control screen assembly 230, a packer assembly 236, a cross-over assembly 238 and a wash pipe 240. Base pipe 242 of sand control screen assembly 230 comprises composite coiled tubing 244 that includes energy conductors 246 integrally positioned therein. A series of sensors 248 embedded within the interior surface of base pipe 242 are coupled to energy conductors 246 to monitor wellbore properties within the annulus 250 formed between base pipe 242 and wash pipe 240.

Figure 12:
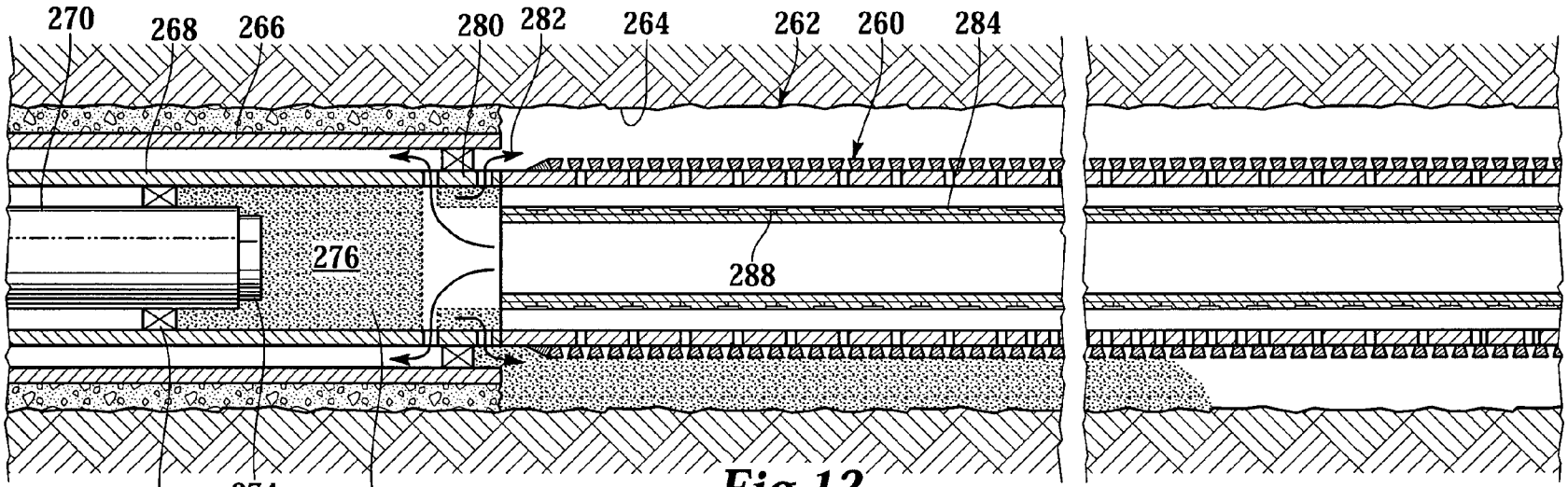
FIG. 12 is a half sectional view depicting the operation of another embodiment of an apparatus for gravel packing a horizontal open hole production interval of a wellbore of the present invention during the propagation of an alpha wave.

Referring flow to FIG. 12, an apparatus 260 for monitoring fluid properties within a production interval 262 is depicted. A wellbore 264 includes casing 266 which is cemented therewith. A work string 268 extends through casing 266 and into production interval 262. An outer tubular 270 is positioned within work string 268 and a packer assembly 272 provides a seal therebetween. An inner tubular 274 is positioned within outer tubular 270. In operation, tubular 270 provides carrier fluid and a tubular 274 provides sand, gravel or proppants into a downhole mixer which provides a mixing area 276 wherein the carrier fluid and the solids mix to form fluid slurry 278. Fluid slurry 278, in turn, is delivered to production interval 262 via a cross-over assembly 260 as indicated by arrows 282.

As previously discussed, a wash pipe 284 positioned within sand control screen assembly 286 includes sensors 288 to monitor data relative to fluid slurry 278 and the wellbore environment in production interval 262 and to relay this data preferably to a downhole process the controls valving or other control equipment associated with tubulars 270, 274 so that the characteristics of fluid slurry 278 may be adjusted by, for example, regulating the relative volume of carrier fluid to solids or the over all rate of component delivery to mixing area 276 from tubular 270 and tubular 274, thereby regulating the characteristics of fluid slurry 278 in substantially real time. In particular, this embodiment allows for rapid changes in fluid slurry characteristics as the fluid slurry composition is mixed close to its delivery point as opposed to at the surface, thereby further enhancing the benefits of the present invention. It should be appreciated that the exemplary mixing embodiment presented herein may be employed with any of the apparatuses for monitoring fluid properties presented hereinabove.

Figure 13:
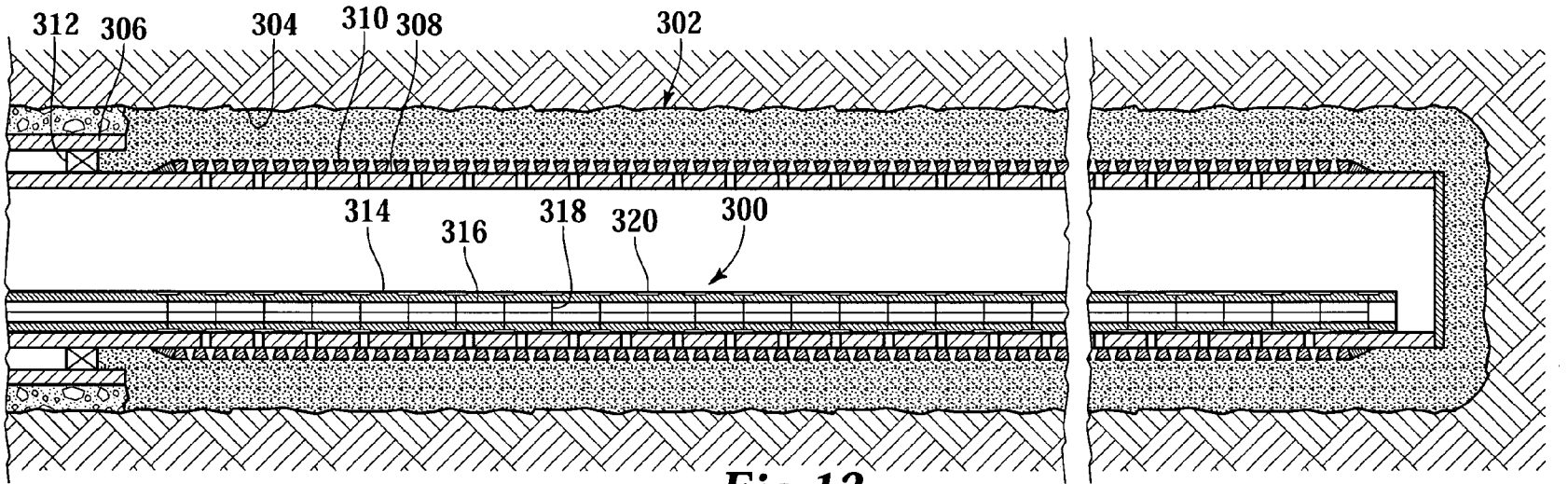
FIG. 13 is a half sectional view depicting the operation of another embodiment of an apparatus for monitoring fluid parameters during production from a horizontal open hole production interval of a wellbore of the present invention.

FIG. 13 is a further embodiment of an apparatus 300 for monitoring fluid properties in a horizontal open hole production interval 302 of a wellbore 304 of the present invention. Casing 306 is cemented within a portion of wellbore 304. Production tubing string 308 includes sand control screen assembly 310 and packer assembly 312 that provides a seal between production tubing string 308 and casing 306.

A tubular 314 extending from the surface is formed from composite coiled tubing 316 and is positioned within production tubing string 308. Energy conductors 318 are integrally positioned within composite coiled tubing 316. Preferably, composite coiled tubing 316 includes a relatively small diameter so that composite coiled tubing 316 does not interfere with the production of the well. A series of sensors 320 embedded within composite coiled tubing 316 are coupled to energy conductors 318 which are spaced at predetermined intervals along the exterior of composite coiled tubing 316 to monitor fluid properties within the production tubing string 308 to develop production profiles including hydrocarbon production, water encroachment, gas breakthrough and the like. It should be appreciated from the foregoing exemplary embodiments that the sensors of the present invention may be positioned in a variety of places such as within the interior or exterior of a base pipe, within the interior or exterior of a wash pipe or within the interior or exterior of a tubular positioned within a production tubing string. Moreover, it should be appreciated that the sensors may be employed in a combination of the aforementioned places.

Accordingly, the present invention provides an apparatus and method for gravel packing long production intervals that are inclined, deviated or horizontal. In particular, the systems and methods of the present invention are useful in extremely long wellbores where substantially real time data about fluid properties is essential to achieve an effective treatment. Hence, the present invention enables fluid properties at a plurality of locations within a production interval of a wellbore to be monitored in substantially real time, thereby providing for the enhanced regulation of treatment processes and fluid production.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A method for treating a production interval of a wellbore, the method comprising the steps of:

positioning a sand control screen assembly within the production interval;

disposing a wash pipe assembly interiorly of the sand control screen assembly;

injecting a treatment fluid into the production interval exteriorly of the sand control screen assembly;

sensing data relative to a property of the treatment fluid during the injecting with a sensor operably associated with the wash pipe; and regulating a characteristic of the treatment fluid during the injecting based upon the data.

2. The method as recited in claim 1 further comprising relaying the data to the surface via an energy conductor integrally associated with the wash pipe.

3. The method as recited in claim 1 further comprising relaying the data to a downhole processor.

4. The method as recited in claim 1 wherein the step of sensing data relative to a property of the treatment fluid further comprises the step of sensing fluid viscosity.

5. The method as recited in claim 1 wherein the step of sensing data relative to a property of the treatment fluid further comprises the step of measuring temperature.

6. The method as recited in claim 1 wherein the step of sensing data, relative to a property of the treatment fluid further comprises the step of measuring pressure.

7. The method as recited in claim 1 wherein the step of sensing data relative to a property of the treatment fluid further comprises the step of measuring velocity.

8. The method as recited in claim 1 wherein the step of sensing data relative to a property of the treatment fluid further comprises the step of measuring specific gravity.

9. The method as recited in claim 1 wherein the step of sensing data relative to a property of the treatment fluid further comprises the step of measuring conductivity.

10. The method as recited in claim 1 wherein the step of sensing data relative to a property of the treatment fluid further comprises the step of measuring fluid composition.

11. The method as recited in claim 1 wherein the step of injecting a treatment fluid into the production interval further comprises performing a treatment process selected from the group consisting of gravel packing, frac packing, acid treatments, conformance treatments, resin consolidations and chemical treatments.

12. The method as recited in claim 1 wherein the step of regulating a characteristic of the treatment fluid further comprises the step of regulating the fluid viscosity of the treatment fluid.

13. The method as recited in claim 1 wherein the step of regulating a characteristic of the treatment fluid further comprises the step of regulating the proppant concentration of the treatment fluid.

14. The method as recited in claim 1 wherein the step of regulating a characteristic of the treatment fluid further comprises the step of regulating the flow rate of the treatment fluid.

15. A method for monitoring treatment fluid in a production interval of a wellbore during a treatment process, the method comprising the steps of:

positioning at least one sensor within the production interval of the wellbore;

sensing data relative to a property of the treatment fluid during the treatment process; and regulating a characteristic of the treatment fluid during the treatment process based upon the data.

16. The method as recited in claim 15 further comprising the step of relaying the data to the surface.

17. The method as recited in claim 15 further comprising relaying the data to a downhole processor.

18. The method as recited in claim 15 wherein the step of sensing data relative to a property of the treatment fluid further comprises the step of sensing fluid viscosity.

19. The method as recited in claim 15 wherein the step of sensing data relative to a property of the treatment fluid further comprises the step of measuring temperature.

20. The method as recited in claim 15 wherein the step of sensing data relative to a property of the treatment fluid further comprises the step of measuring pressure.

21. The method as recited in claim 15 wherein the step of sensing data relative to a property of the treatment fluid further comprises the step of measuring velocity.

22. The method as recited in claim 15 wherein the step of sensing data relative to a property of the treatment fluid further comprises the step of measuring specific gravity.

23. The method as recited in claim 15 wherein the step of sensing data relative to a property of the treatment fluid further comprises the step of measuring conductivity.

24. The method as recited in claim 15 wherein the step of sensing data relative to a property of the treatment fluid further comprises the step of measuring fluid composition.

25. The method as recited in claim 15 wherein the treatment process is selected from the group consisting of gravel packing, frac packing, acid treatments, conformance treatments, resin consolidations and chemical treatments.

26. The method as recited in claim 15 wherein the step of regulating a characteristic of the treatment fluid further comprises the step of regulating the fluid viscosity of the treatment fluid.

27. The method as recited in claim 15 wherein the step of regulating a characteristic of the treatment fluid further comprises the step of regulating the proppant concentration of the treatment fluid.

28. The method as recited in claim 15 wherein the step of regulating a characteristic of the treatment fluid further comprises the step of regulating the flow rate of the treatment fluid.

* * * * *